US008735703B2

(12) United States Patent
Dublin

(10) Patent No.: US 8,735,703 B2
(45) Date of Patent: May 27, 2014

(54) PERCUSSION INSTRUMENT

(76) Inventor: Dion Dublin, Norwich (GB)

( * ) Notice: Subject to any disclaimer, the term of this patent is extended or adjusted under 35 U.S.C. 154(b) by 0 days.

(21) Appl. No.: 13/320,793

(22) PCT Filed: May 21, 2010

(86) PCT No.: PCT/GB2010/050836

§ 371 (c)(1),
(2), (4) Date: Feb. 6, 2012

(87) PCT Pub. No.: WO2010/133892

PCT Pub. Date: Nov. 25, 2010

(65) Prior Publication Data

US 2012/0132058 A1 May 31, 2012

(30) Foreign Application Priority Data

May 21, 2009 (GB) ..... 0908708.1

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS

| | | | | |
|---|---|---|---|---|
| 2,858,724 | A * | 11/1958 | Troppe | 84/411 R |
| 2,900,453 | A * | 8/1959 | Cammack | 381/355 |
| 3,136,201 | A | 6/1964 | Lang et al. | |
| 5,159,139 | A | 10/1992 | Beals et al. | |
| 5,292,276 | A | 3/1994 | Manalo | |
| 5,385,075 | A | 1/1995 | Carnes et al. | |
| 7,547,836 | B2 * | 6/2009 | Reed | 84/411 R |
| 7,807,910 | B1 * | 10/2010 | Berardo | 84/411 R |
| 2009/0013849 | A1 | 1/2009 | Payerl | |

FOREIGN PATENT DOCUMENTS

| | | |
|---|---|---|
| DE | 3205136 | 8/1983 |
| DE | 3503866 | 10/1985 |
| DE | 202006012202 | 10/2006 |
| DE | 202006008418 | 11/2006 |
| DE | 202007000686 | 6/2007 |
| FR | 2902921 | 12/2007 |
| GB | 2334366 | 8/1999 |
| GB | 2464727 | 4/2010 |
| JP | 11173876 | 7/1999 |
| WO | WO96/13027 | 5/1996 |
| WO | WO2007/084718 | 7/2007 |

OTHER PUBLICATIONS

Steve Weiss Music; Meinl American White Ash Pickup Cajon with Snare Wires; review posted Dec. 4, 2008 http://www.steveweissmusice.com/product/1108407/1108407/djembe-cajon#reviews; 3 pages.

(Continued)

*Primary Examiner* — Kimberly Lockett
(74) *Attorney, Agent, or Firm* — Thorpe North & Western LLP

(57) ABSTRACT

A percussion instrument (1) in the form of a drum being a rectangular parallelepiped or a cuboid in shape and having three or more live striking faces (2), wherein each striking face (2) has a different percussive property. The invention further comprises a stand (30) specifically adapted to support a percussion instrument (1) in the form of a cuboid drum.

10 Claims, 7 Drawing Sheets

(56) References Cited

OTHER PUBLICATIONS

DrumWright; Latin, Ethnic and Orchestral Percussion Forum: Cajon; Jun. 29, 2006; http://www.drumwright.co.uk/forums/topic-TOPIC_ID-2086.htm-2086.htm.

Rhythmweb; The LapDrum from SlapDrum: Review by Eric Stuer; 2004; http://www.rhythmweb.com/reviews/slapdrum.htm; 1 page.

Amazon.co.uk; Drum by Pintoy; Review published Mar. 18, 2006; http://www.amazon.co.uk/PINTOY-5202-Drum/dp/B0000AC98D; 5 pages.

Fledgling News; Mozart Magic Cube; Issue 5; Published Autumn 2003; http://www.fledglings.org.uk/content/view/136/1/ (webpage no longer available).

Early Learning Centere; Musical Activity Set; Reviewed Apr. 22, 2008 http://www.elc.co.uk/to/musical-activity-set/.

Steve Weiss Music; Meinl American White Ash Pickup Cajon with Snare Wires; review posted Dec. 4, 2008 http://www.steveweissmusice.com/product/1108407/djembe-cajon#reviews.

DrumWright; Latin, Ethnic and Orchestral Percussion Forum: Cajon; Jun. 29, 2006; http://www.drumwright.co.uk/forums/topic-TOPIC_ID-2086.htm.

Rhythmweb; The LapDrum from SlapDrum: Review by Eric Stuer; 2004; http://www.rhythmweb.com/reviews/slapdrum.htm.

* cited by examiner

PERCUSSION INSTRUMENT

FIELD OF THE INVENTION

The invention relates to percussion instruments and is specifically concerned with percussion instruments in the form of a drum. Also within the ambit of the invention is a stand for such a drum.

THE INVENTIVE CONCEPT

This application is related to Patent Application GB0819564.6, filed on 24 Oct. 2008 and naming as applicant Dion Dublin. The idea contained in that application has been improved upon and modified, introducing a number of new and inventive features neither contained in that application nor in the documents raised against that application.

Percussion drums are conventionally designed to produce their sound by striking the drum's playing surface with drumsticks or, in some cases, with the fingers and palm of the player. Such conventional drums are also designed either to be mounted on a stand or to be held between the player's knees. In each case, they are therefore relatively formal items and, whilst they can be carried from site to site, they are not designed or adapted to be readily manipulated during play.

The well known need of many people nowadays to have something to manipulate is taken care of conventionally by flexible and relatively small multi-limbed and/or differentially shaped finger-handled objects—often given the generic name "executive toys"—which can be twisted, turned, and otherwise played with to give some repeated measure of relief to the user. These act as an effective outlet for excess energy as well as, or instead of, pent-up frustration on the part of the user.

None of these disparate objects provides any outlet at all for the natural and indeed overwhelming urge in many people to have something on which to tap out a rhythm, repetitively, for sheer enjoyment and which is large enough to give a pleasingly reverberating sound whilst being sufficiently compact and relatively light weight to be picked up, carried around, and manipulated and swivelled between the player's outstretched hands as the rhythmic striking of the object gathers pace.

STATE OF THE ART

The documents listed below were raised against patent application GB0819564.6 and therefore form the state of the art as the Applicant understands it. The documents are as follows:

DE3503866A1 HOSHINO GAKKI
FR2902921A1 ROBERT NICHOLAS
WO96.13027A1 RAMSELL, CRAIG
DE3205136A1 WILL GEB KLEIN
U.S. Pat. No. 3,136,201 LANG ET AL
U.S. Pat. No. 5,292,276 MANOLO
JP11173876A KORG INC
U.S. Pat. No. 538,075 CARNES ET AL
http://www.amazon.co.uk/PINTOY-5202-DRUM/dp/B0000AC98D—"Drum by Pintoy"
http://www.fledglings.org.uk/content/view/136/1/

SUMMARY OF THE INVENTION

In a first broad independent aspect, the invention provides a percussion instrument in the form of a drum being a rectangular parallelepiped such as a cuboid in shape and having three or more live striking faces configured differently in order to have different percussive properties. In addition to having different resistance to a strike force, the differing faces may have different tonal properties or achieve different playing effects. This configuration is particularly advantageous because it allows an increase in playing options and/or effects whilst presenting three or more faces which can withstand repetitive percussions throughout the use of the instrument. It also provides an improvement in the distribution of impacts throughout use and therefore increases its resistance to percussions damage which all instruments eventually suffer from. It also provides a particularly compact instrument for the level of versatility achieved.

The faces may be of a material selected from the group comprising: MDF, ply, wood, metals and polymers. A combination of a number of faces of MDF and a number of faces of ply wood provides advantageous structural and musical range properties.

The faces may optionally be formed as a wall with sides which are adjacent to and/or in abutment with the sides of the wall of neighbouring faces. This allows the faces to collectively form substantially the entire exposed surface of the parallelepiped. This further improves the collective strength and toughness of the instrument.

One particularly advantageous option is achieved by employing stricking faces of different or differing thickness. This may for example allow one or more faces to be dead faces in use which may be of greater thickness than other faces. This would further strengthen the configuration as opposed to conventional approaches. In this configuration, the dead face(s) can contribute significantly to the overall rigidity of the instrument. This would therefore minimise the necessary structural components. A further preferred optional configuration is achieved by employing stricking faces of differing construction in order to obtain different tones or playing effects. This may allow faces to be configured to have greater wear resistance dependent on predetermined strike patterns. A further particularly advantageous option is achieved by employing stricking faces of differing density. This is particularly versatile in terms of construction since it would allow portions of support structures to be identical irrespective of the faces which are secured to the support structures whilst still providing the variation in tonal properties.

In a subsidiary aspect, each striking face is substantially identical in surface area. This is particularly advantageous in terms of balance.

In a further subsidiary aspect, the invention further comprises four live striking faces, and two dead faces, which are not for striking. This configuration is particularly advantageous in terms of distribution of forces in the instrument.

In a further subsidiary aspect, the invention further comprises at least one handle formed integrally from a dead face. This configuration is particularly advantageous since it reduces the required components and simplifies its requirements for assembly.

In a further subsidiary aspect, the invention further comprises a cavity, the cavity containing an acoustic to electric transducer, the electric transducer being suspended within the cavity. This configuration is particularly advantageous in terms of capture of sound. It is further advantageous when a diagonally extending beam is employed since it achieves extra structural strength and the ability to place the pick up in an optimum position for picking sound irrespective of the live faces struck.

In a further subsidiary aspect, the electric transducer is suspended substantially at the centre of the cavity. This is particularly advantageous to pick up sound irrespective of the live faces struck.

In a further subsidiary aspect, the electric transducer is suspended by one or more beams. This adds extra rigidity to the instrument.

In a further broad independent aspect, the invention provides a percussion instrument in the form of a drum substantially as described herein with reference to and as illustrated in the accompanying drawings.

In a further broad independent aspect, the invention provides a stand specifically adapted to support a percussion instrument in the form of a cuboid drum according to any of the preceding aspects.

EMBODIMENTS OF THE INVENTION

In a presently preferred practical embodiment of the invention, the drum is a cube-shaped drum with a side length lying within the range 12 inches to 18 inches (approximately 30 cm to 45 cm) and preferably a side length of approximately 15 inches (say 40 cm) and its faces are perforated so as to give, to a user of the drum, a pleasingly varied reverberative sound output as he taps, slaps, strikes with the heel of his palm, and otherwise assaults the drum manually in an extempore and usually spontaneous manner.

Other aspects of the invention will become apparent from reading the description which now follows with reference to the accompanying drawings forming part of this specification. The scope of the invention as such is defined in the numbered claims at the end of the description text.

BRIEF DESCRIPTION OF THE FIGURES

The invention will now be described with reference to the following figures, of which.

DESCRIPTION OF THE PREFERRED EMBODIMENTS OF THE INVENTION

This invention comprises a percussion instrument in the form of a drum being rectangular parallelepiped which is preferably cuboid in shape and having three or more live striking faces, wherein each striking face is of a different thickness or density. The invention further comprises a stand specifically adapted to support a percussion instrument of that form.

Figure 1:
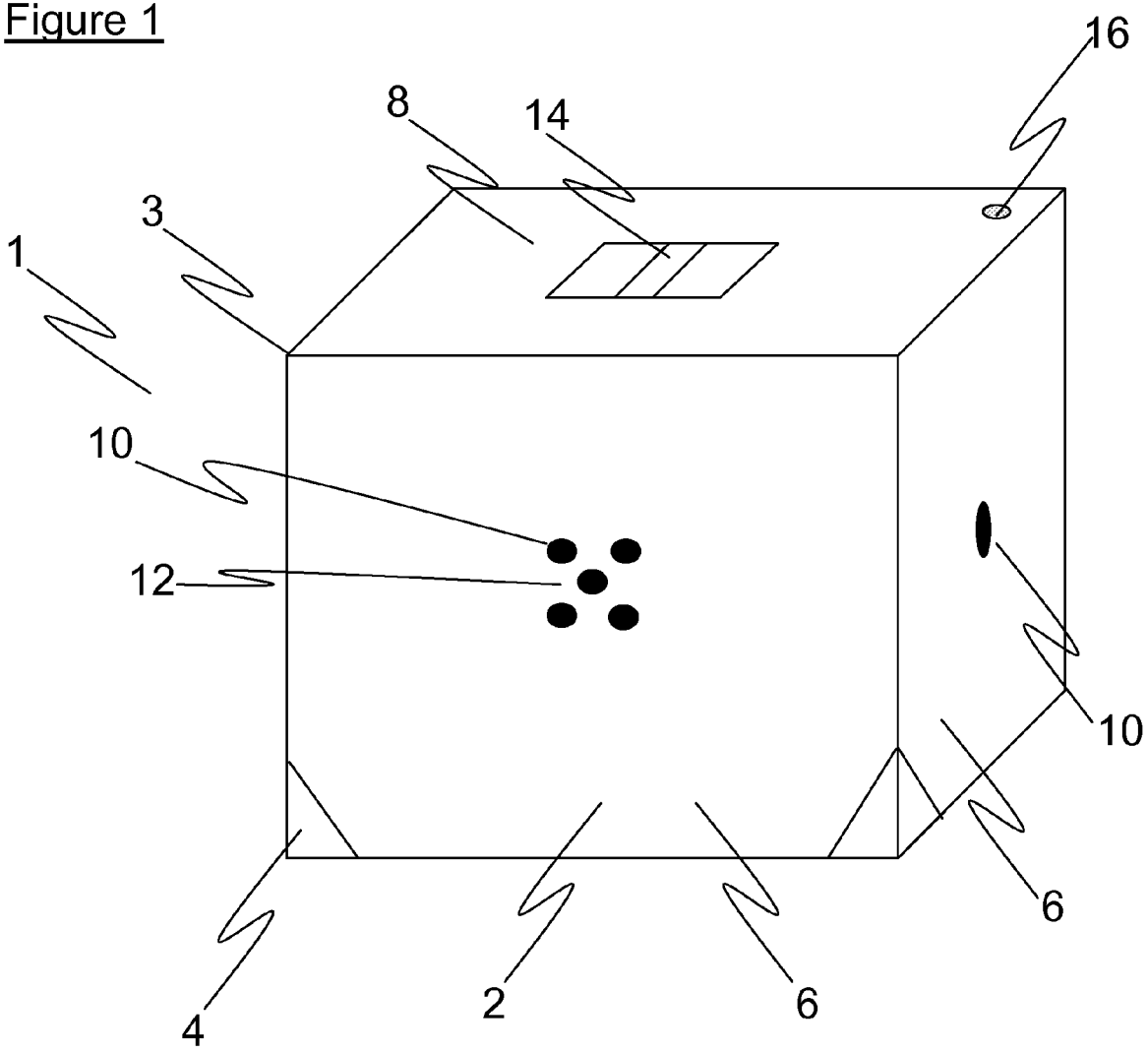
FIG. 1 is a perspective view of a percussive drum embodying the invention.

At FIG. 1 is shown generally a preferred embodiment of a percussive drum 1. The drum 1 has six faces or sides 2 and is cuboid in shape. In preferred embodiments, the drum 1 is a cube. Each side 2 of the drum 1 therefore has four corners 3, which may be overlaid by corner protectors 4. Said corner protectors 4 are preferably made of leather, a material which is characterised by a desirable combination of protective resilience and aesthetic qualities, although other materials may also be appropriate.

In this embodiment, four of the sides 2 are live drum faces 6, or striking faces (including two which are not shown) and two of the sides 2 are dead faces 8 (including one which is not shown). The percussion drum 1 has a side length of approximately 15 inches (or 40 cm). Each of the sides 2 is made of medium density fibre board (MDF), although wood, plywood, chipboard and other wood derivatives may be used, as well as synthetics, metals or other materials deemed appropriate—for example for their tonal properties. Individual sides 2 of a single percussion drum 1 may be made of different materials. The sides 2 may be of different individual densities, as well as or instead of different thicknesses. The sides are attached to one another via screws, nails, adhesive or a combination of the above.

Each of the faces 6, 8 comprises one or more perforations 10. Perforations 10 penetrate all the way through the live face 6 upon which they are situated. The size, number and formation of perforations 10 may be altered as desired to adjust the volume and the timbre of a given live face 6. The preferred configuration 12 of perforations 10 is shown at FIG. 1. It has been found that this configuration 12 produces an optimal balance of timbre, tonality and loudness. The live faces 6 are perforated so that sounds produced by striking a face 6 would cause the face 6 to reverberate and that reverberation will be reflected internally then out via the perforations or holes 10 formed in the face 6.

In some embodiments, the dead faces 8 thereby advantageously provide a location for other features of the drum 1 as well as a means for resting the drum 1 on a surface without compromising its playability. The dead faces 8 may carry a handle 14, as shown in FIG. 1. Here, handle 14 is carved into or otherwise fashioned from the material of a dead face 8. The carving in of handle 14 is of course only one means of attaching such a feature to a drum 1. However, by integrating handles 14 into the dead faces 8, handle 14 is added in a discreet fashion and in a manner which does not interfere with the ergonomics and aesthetics of the design of the drum 1. Whilst there may, in some embodiments, be two handles 14; one in each dead face, the preferred location of the handle is shown at FIG. 6.

Figure 6:
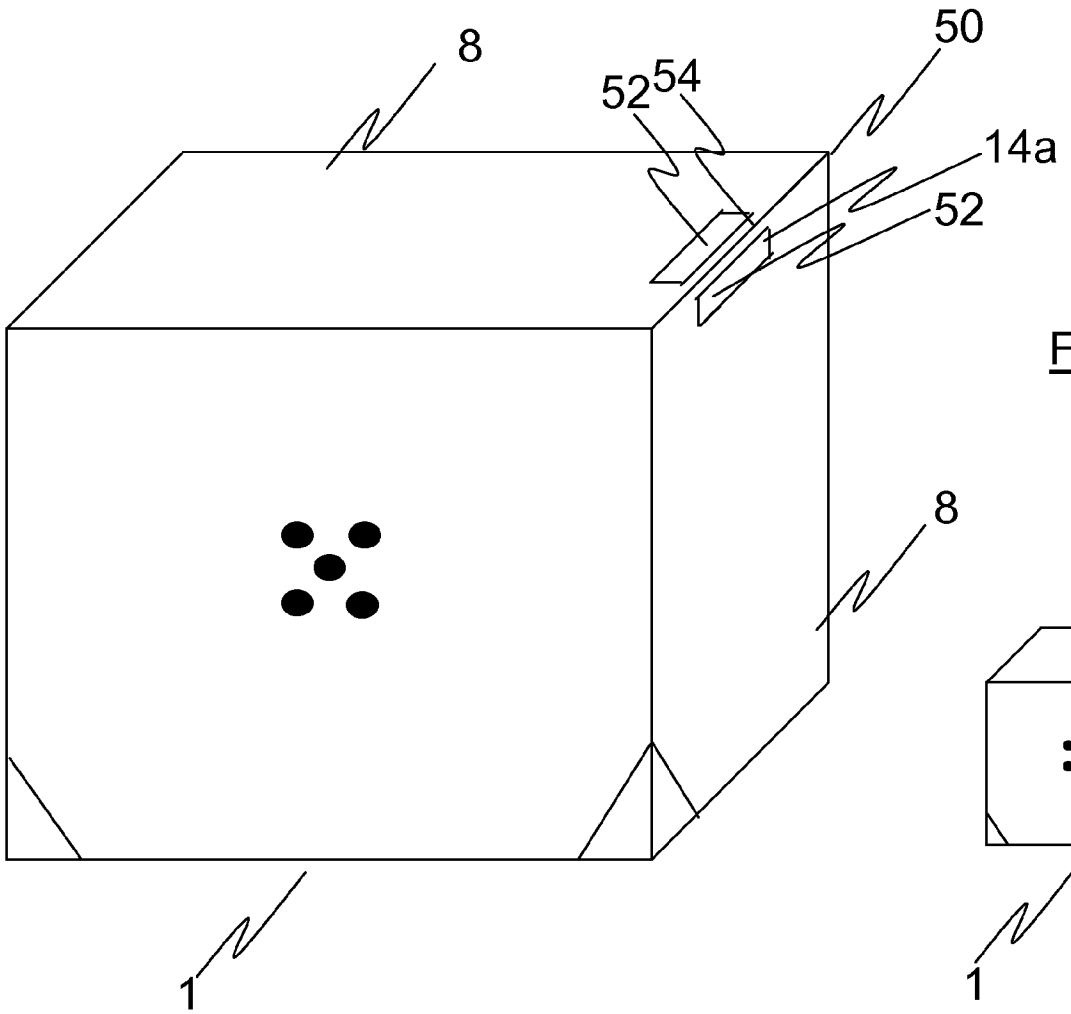
FIG. 6 is a perspective view of a further embodiment of a percussive drum of the invention.

The drum 1 at FIG. 6 comprises several advantageous preferred features. The first advantageous feature is that the dead faces 8 are perpendicular to each other and so form an edge 50. The key advantage to this comes when playing the drum 1; the dead faces 8 may be held between the user's knees, allowing easy access to the remaining four live faces 6.

Figure 7:
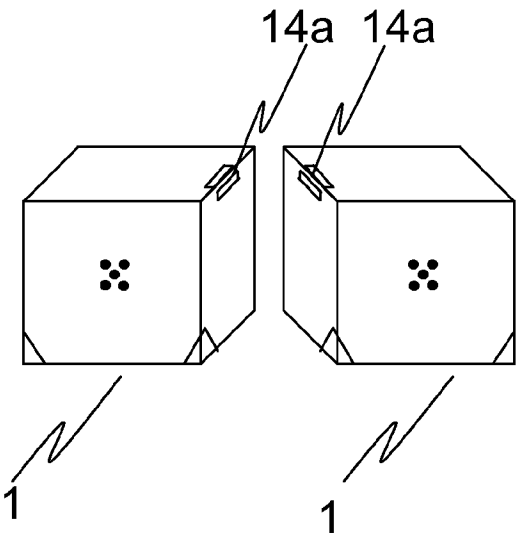
FIG. 7 is a perspective view of a plurality of percussive drums, in a further embodiment of the invention.

The second key feature is the placing of handle 14*a* at edge 50—in the edge at which the dead faces 8 meet. Handle 14*a* comprises a recess 52 scooped or carved from dead faces 8. Said recess 52 is spanned by a bar 54 which may either be formed from wood left over from forming recess 52, or through the subsequent addition of a separate part, which may be of plastics or metal. Whilst the placement of handle 14*a* in this manner provides a generally desirable carrying means, with the aesthetic and ergonomic advantages identified as afforded by recessed handles above, a particular advantage is shown at FIG. 7; namely that two cubes 1 may be arranged in such a way that the handles 14*a* face each other, thus facilitating the easy carrying by the user of two cubes with one hand. Its location also improves its mechanical properties. The drum will withstand greater stresses and strains due to the location of the handle in this position when compared to the middle of a face of a drum.

Returning to FIG. 1, also present on the visible dead face 8 is jack 16. This jack 16 allows electro acoustic versions of the drum 1 to be attached to other audio equipment, notably amplification and processing means. Another embodiment of jack 16 may be replaced or supplemented by a radio transmitter and/or a preamp. Purely acoustic versions of the drum 1 are also envisaged.

Optionally, a side 2 of the percussive drum 1, preferably a dead face 8, incorporates a removal central region which is a tight fit in the rest of the given side 2 and incorporates a thumbnail undercut region to allow it to be prised out of its surrounding side 2 area when the user desires to remove it. This gives access to the interior of the drum 1 enabling adjusting of features associated with an interior, or internal cavity, as discussed below.

Figure 2:
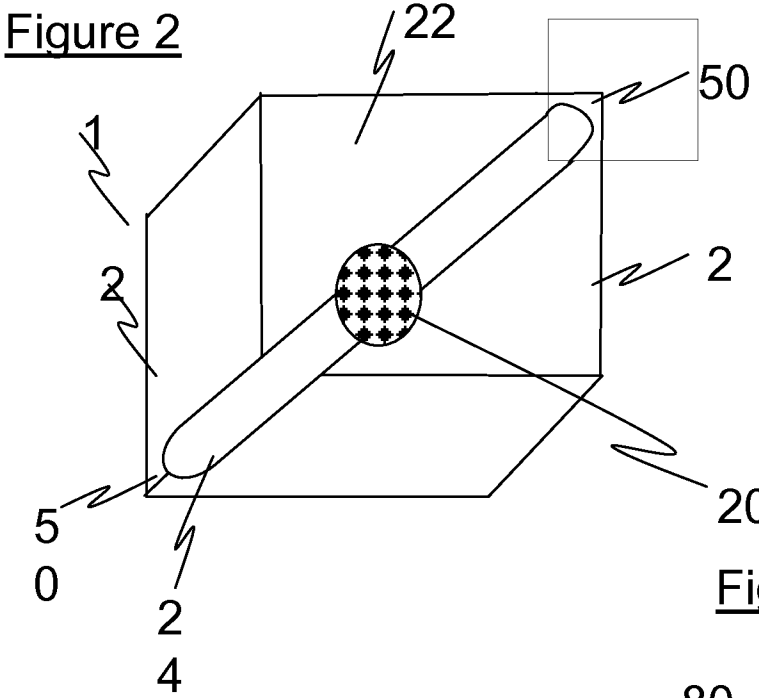
FIG. 2 is a perspective view of the inside of a percussive drum embodying the invention.

FIG. 2 shows an embodiment of drum 1. Inside the drum 1 an acoustic to electric transducer such as a microphone 20 or pickup is suspended in central cavity 22 formed by the sides 2 of the drum 1. The microphone 20 is held there by virtue of beam 24 which runs diagonally between opposing internal corners 50 of the drum 1. This preferred embodiment shows microphone 20 suspended by a single beam 24 although clearly multiple beams are possible. The beam 24 could be substituted with a taut wire. The suspension of the microphone 20 with a beam 24 is advantageous in that said microphone 20 is placed at the centre of cavity 22, that is to say equidistant from each of the sides 4 of the drum 1 with the result that no live face 6 is unintentionally louder than the others. A further advantage in suspending the microphone thus is to isolate said microphone 20 from the vibrations caused by striking the drum. A still further advantage of so mounting the microphone 20 is that it is less likely to be shaken from position. An advantage of using a beam 24 as the means of suspending the microphone is that the beam 24 may be hollow, thereby providing a passage (not shown) to connect the microphone 20 to the jack 16 (shown in FIG. 1) or similar. Access to the microphone 20 may optionally be by way of removal of the handle 14 (shown in FIG. 1), which need not be integrated; in some preferred embodiments, but may instead be of metal, and may be releasably attached to the drum 1 by screws, or a releasable attachment means, or may clip in.

Figure 2A:
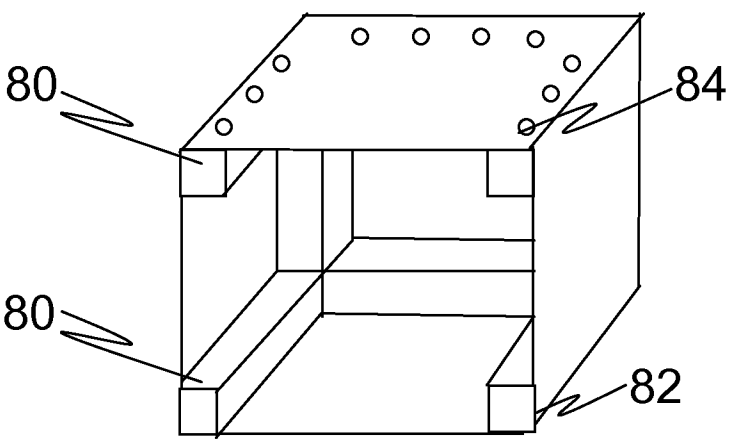
FIG. 2*a* is a cross-sectional perspective view showing the bracing inside the percussive drum.

At FIG. 2*a*, there is shown drum 1 with internal bracing 80, which in this embodiment comprises a series of elongate blocks of wood, placed parallel to the edges 82 of the drum 1. The blocks may be made of alternative materials, but wood is favoured. The internal bracing 80 forms a frame, upon which sides 2 may be mounted to form the drum 1. The sides 2 are joined to the frame via screws, bolts, pegs or the like, with filler or adhesive. In preferred embodiments, the screws bolts pegs or the like join the bracing 80 through apertures 84 formed in the sides 2 themselves. When the sides 2 are joined, any remaining gaps in the apertures 84 are filled with filler. The filler is preferably applied so as to form a flat plane with the rest of face 2. The use of bracing 80 advantageously provides a more resilient means of construction than merely attaching the sides on to one another.

Figures 3, 4:
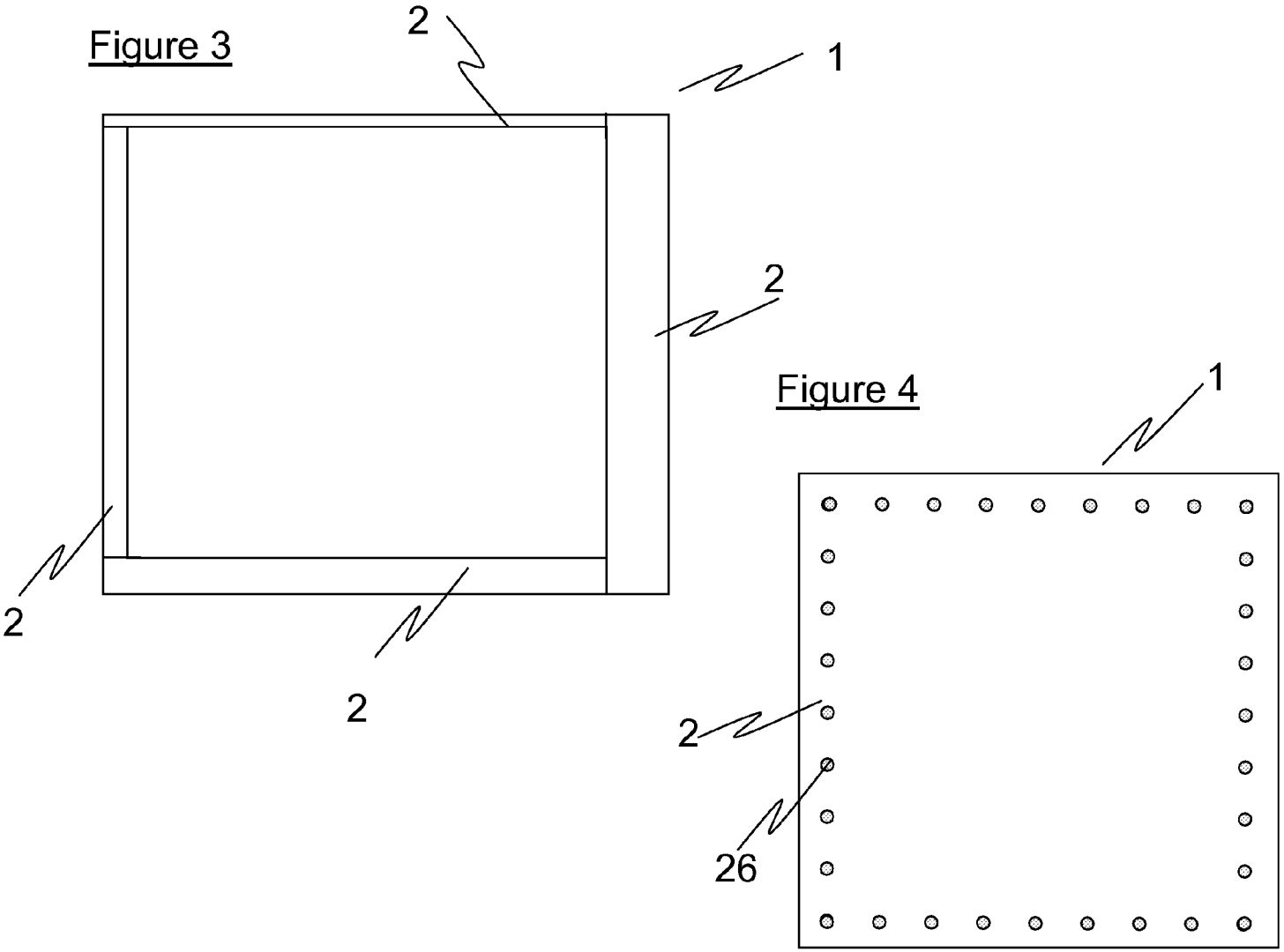
FIG. 3 is a side view of a percussive drum embodying the invention.
FIG. 4 is a cross sectional side view of a percussive drum embodying the invention.

FIG. 3 shows a drum 1 in cross section. It illustrates how in preferred embodiments of the invention each of the live faces 6 is of a different thickness. The variation of thickness is advantageous because different thicknesses of live faces 6 will produce different notes and tonal qualities. It is possible to produce a variety of tuned drums wherein the different thicknesses of the live faces 6 comprise a scale or arpeggio in a given key.

At FIG. 4 is shown a side 2 of a drum 1. The side 2 is attached to other sides (not shown) via screws 26. The screws 26 are spaced regularly around the perimeter of a given side. The use of screws 26 to attach sides 2 together has been shown to be a particularly sturdy and desirable manner of so attaching. Other means, allowing for given panels to be readily removable and replaceable, are also envisaged.

Figure 5:
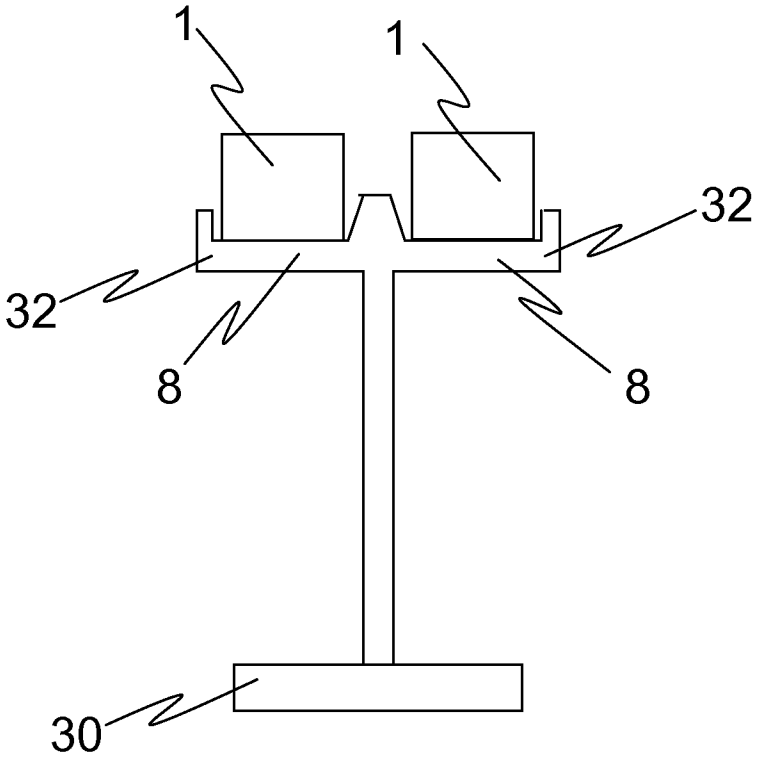
FIG. 5 is a side elevational view of a stand holding two percussive drums embodying the invention.

At FIG. 5 is a stand 30 on which two drums 1 are mounted. The dead faces 8 of the drums are in contact with the stand. Advantageously the stand's drum holding portions 32 may feature a means for interfacing with the handles 14 of the drums 1, providing for example releasable locking means.

Figure 8:
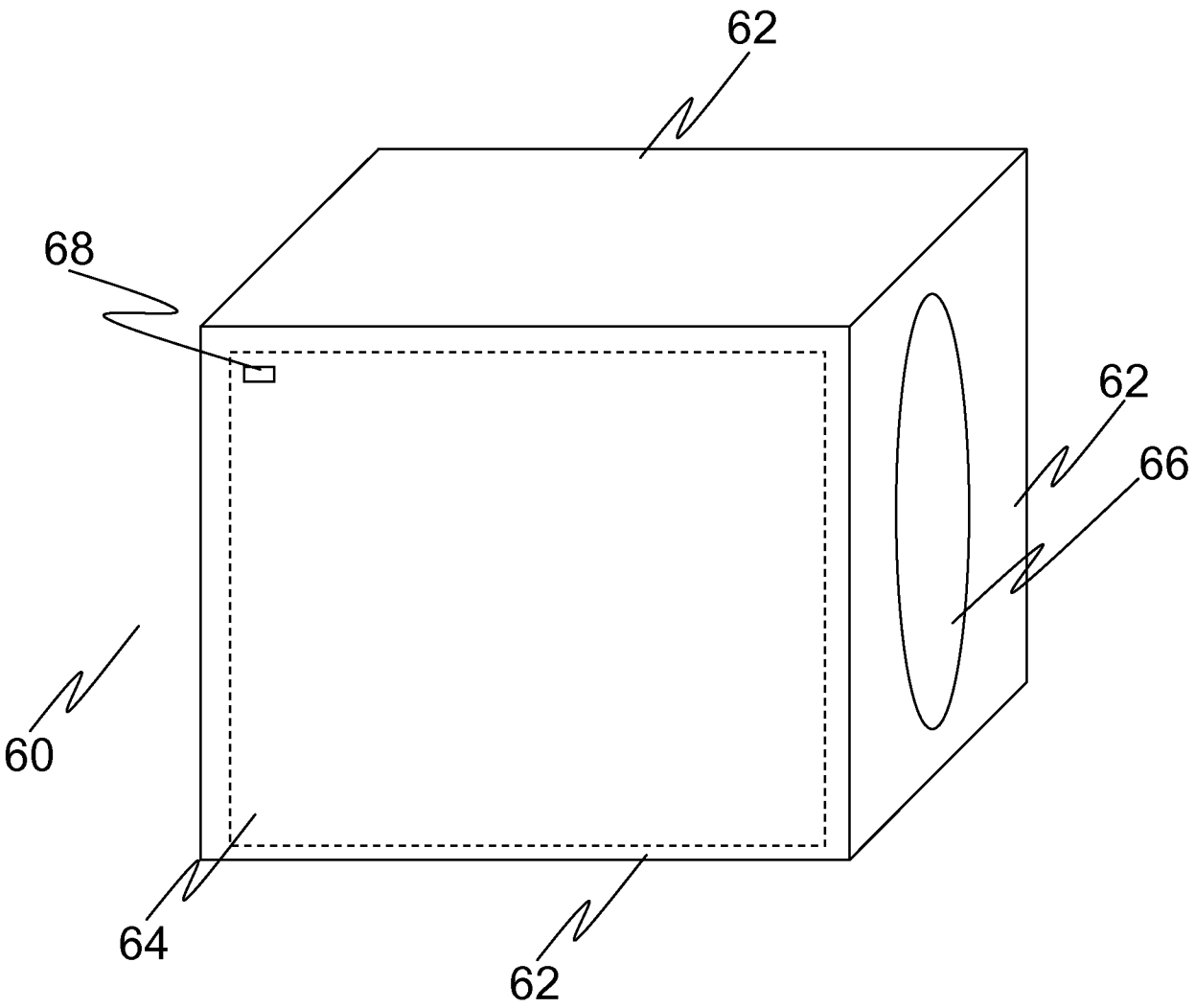
FIG. 8 is a perspective view of a further embodiment of the invention in the form of a controller.

At FIG. 8, there is shown a drum 60. The drum 60 is adapted to be a gaming controller, and may, via means known to the skilled man, be made compatible with any gaming system. Alternatively it may be a stand alone gaming system, with built in or uploadable programmes—the drum 60 may have processing and data storage means (neither of which are shown) to facilitate this. The drum 60 has a plurality of sides 62, at least one of which comprises a sensor 64. Such a configuration could be embodied as a midi controller, or similar such interface, for triggering synthetic and sampled drum sounds.

Returning to the gaming controller; contingent on the game being played, interactions with the sensors may bring about sonic and visual responses from the drum, by way of a sound source such as a speaker 66 which may either be internal, or external as shown, or a light source, which may take the form of one or more lights 68. In a particularly preferred embodiment, the sides 62 are translucent, and are underlit by lights 68.

Figure 9:
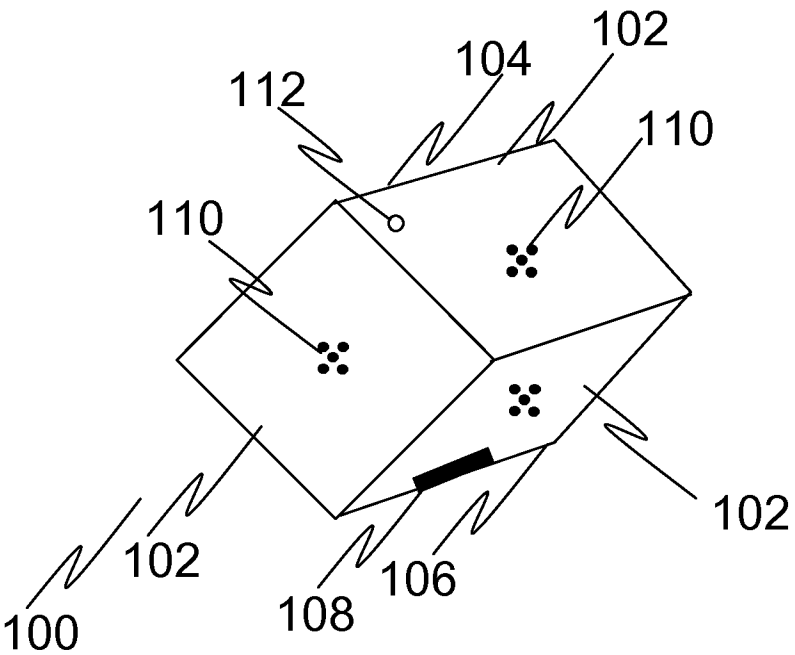
FIG. 9 is a perspective view of a further percussive drum of the invention.

At FIG. 9 is shown a particularly preferred embodiment of the invention. Drum 100 is a cube. Of the six faces 102, three are shown. The drum 100 is orientated on the page in the manner in which it would be played; drum 100 has an apex 104 and a nadir 106. The two faces 102 on either side of the nadir 106 are dead faces; although it is the case they may be hit. The two faces 102 adjacent nadir 106 are made of much thicker material than the other faces so that when they are hit they make a much quieter sound—they resonate a lot less than the live faces, being relatively inflexible; more rigid. Of the remaining four faces 102 there are two made of plywood and two of MDF. The thinnest of the two MDF live faces is of substantially the same thickness as the thinner of the two plywood faces and the thicker of the two MDF faces are substantially the same thickness as the thicker of the two plywood faces. In this case then, there are three different thicknesses of faces, counting the dead faces. Drum 100 has a handle 108, which is mounted into the two faces adjacent the nadir 106. In this preferred embodiment all faces have perforations 110. Also in this embodiment a live face adjacent the apex 104 carries a jack socket 112 for connecting the internal microphone (not shown) to an external amplification source.

The scope of the invention is now formally defined in the numbered claims which follow.

The invention claimed is:

1. A percussion instrument in the form of a drum being a parallelepiped in shape and, further comprising four live striking faces, and two dead faces, which are not for striking, wherein each striking face has a different percussive property and wherein the striking face and the dead faces together comprise substantially the entire outer surface area of the percussion instrument.

2. A percussion instrument according to claim 1, wherein the drum is cuboid in shape.

3. A percussion instrument according to claim 1, wherein each striking face has a different thickness.

4. A percussion instrument according to claim 1, wherein each striking face has a different density.

5. A percussion instrument according to claim 1, wherein each striking face is identical in surface area.

6. A percussion instrument according to claim 1, further comprising at least one handle formed integrally from a dead face.

7. A percussion instrument according to claim 1, further comprising a cavity, the cavity containing an acoustic to electric transducer, the electric transducer being suspended within the cavity.

8. A percussion instrument according to claim 6, wherein the electric transducer is suspended substantially at the centre of the cavity.

9. A percussion instrument according to claim 7, wherein the electric transducer is suspended by one or more beams.

10. A percussion instrument according to claim 1, wherein the two dead faces, the two dead faces comprising a first dead face and a second dead face with each of the first dead face and the second dead face having at least one edge, and wherein the first dead face and the second dead face are joined to one another along said edge, thereby forming a corner.

* * * * *